United States Patent [19]

Subulak et al.

[11] 4,313,110

[45] Jan. 26, 1982

[54] SMOKE ALARM HAVING TEMPORARY DISABLING FEATURES

[76] Inventors: Thomas Subulak, 3605 Fenn Dr., Philadelphia, Pa. 19154; Joseph M. Milewski, 146 E. Louden St., Philadelphia, Pa. 19120

[21] Appl. No.: 122,654

[22] Filed: Feb. 19, 1980

[51] Int. Cl.[3] ..... G08B 21/00; G08B 17/10

[52] U.S. Cl. ..... 340/527; 340/309.6; 340/628

[58] Field of Search ..... 340/628, 629, 630, 309.1, 340/309.6, 573, 309.4, 309.5, 527, 528

[56] References Cited

U.S. PATENT DOCUMENTS 3,255,441 6/1966 Goodwin et al. ..... 340/630 X
3,383,670 5/1968 Roberts ..... 340/630
3,846,773 11/1974 Lintelmann et al. ..... 340/630 X
4,206,450 6/1980 Harden et al. ..... 340/309.1 X

*Primary Examiner*—John W. Caldwell, Sr.
*Assistant Examiner*—Daniel Myer
*Attorney, Agent, or Firm*—Howson and Howson

[57] ABSTRACT

A smoke alarm having means for detecting smoke and producing a signal in response to the detected smoke is provided with a manually-actuated control which cooperates with the signal producing means to temporarily deactivate the same and to automatically reactivate the same after a predetermined time delay. A temperature responsive override switch is provided to actuate the signal in the event of a fire during the time delay. Thus, a homeowner is able to temporarily deactivate the smoke alarm, such as duringcooking, parties, showering, etc. to thereby prevent the alarm from going off in response to non-fire conditions.

8 Claims, 2 Drawing Figures

SMOKE ALARM HAVING TEMPORARY DISABLING FEATURES

FIELD OF THE INVENTION

The present invention relates to smoke alarms, and more particularly, the present invention relates to anti-false alarm devices for use in smoke alarms.

BACKGROUND OF THE INVENTION

There are many types of smoke alarms in use today. The conventional smoke alarm used in the home is a relatively small, battery-powered unit which is mounted at locations where fires are likely to occur. For instance, many homeowners mount such alarms in the kitchen; others may mount the alarms at the tops of stairways, in bedrooms, etc.

While smoke alarms have undoubtedly saved many lives, certain problems have been noted. For instance, it has been found that cooking smoke may set off the alarm, as well as smoke generated when a number of smokers gather in a room where an alarm is located. Furthermore, some types of alarms are known to shut off in response to water vapor produced by showering. It is particularly annoying, not to mention inconvenient, for an alarm to be set off in such a manner.

OBJECTS OF THE INVENTION

With the foregoing in mind, it is an object of the present invention to provide a smoke alarm which avoids the aforementioned shortcomings of known commercially-available smoke alarms.

It is another object of the present invention to provide a smoke alarm device which is capable of being temporarily deactivated to enable a homeowner to cook, smoke or bathe without having any concern about the alarm being falsely set off by these activities.

SUMMARY OF THE INVENTION

As a more specific object, the present invention provides for a smoke alarm having a housing and a unit in the housing for detecting smoke and producing a signal in response to the detected smoke, a manually-actuated control which cooperates with the detecting and signal-producing means to temporarily deactivate the same and automatically to reactivate the same after a predetermined time delay. A temperature responsive switch is provided in the housing to override the control during the period of the time delay for sounding the signal in the event an actual fire should break out. Preferably, the time delay is provided by a solid state timer which cooperates with a latching relay connected in a power supply circuit to the smoke detector and alarm unit to effect the desired deactivating and activating function.

BRIEF DESCRIPTION OF THE DRAWINGS

These and other objects, features and advantages of the present invention should become apparent from the following description when taken in conjunction with the accompanying drawings, in which.

DESCRIPTION OF THE PREFERRED EMBODIMENT

Figure 1:
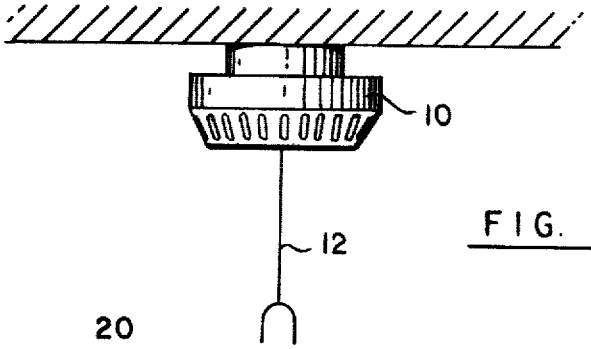
FIG. 1 is a side elevational view of a smoke alarm embodying the present invention.

Referring now to the drawings, FIG. 1 illustrates a smoke alarm 10 embodying the present invention. As seen therein, the alarm 10 is preferably mounted to the ceiling of a room at such a location as to be activated by smoke in the event of a fire. For purposes to be described, a pull chain 12 depends from the alarm 10 to a level convenient to be gripped manually and pulled.

As noted heretofore, one of the problems which has been noticed with respect to conventional smoke detectors has been their proclivity to go off during normal functions. For instance, cooking smoke, cigarette smoke, and vapors from bathing have been known to set off the alarms. As a result, some people have either permanently disconnected their devices, or they suffer the inconvenience of periodically having to put up with false alarms.

According to the present invention, the disadvantages and inconveniences associated with conventional smoke alarms are eliminated while preserving for the homeowner the safety and security of a smoke detector. To this end, the present invention provides means for temporarily deactivating the smoke detector alarm and for automatically activating the same after a predetermined time interval. During this time interval, a thermal override switch is provided to sound the alarm in the event of an actual fire. Thus, a homeowner may go about ordinary routines without having to suffer the annoyance and inconvenience of setting-off his fire alarm inadvertently.

Figure 2:
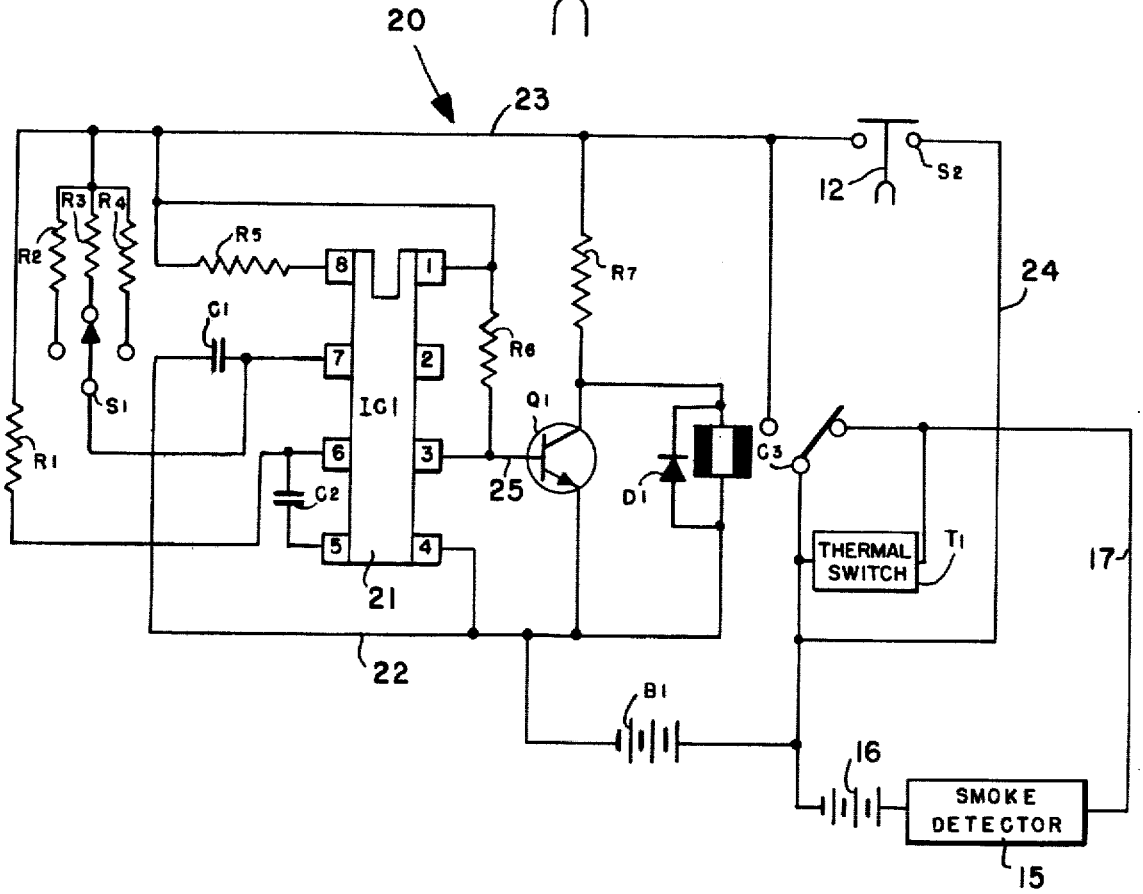
FIG. 2 is a schematic circuit diagram of the present invention.

Referring now to the drawings, FIG. 2 illustrates one preferred embodiment for carrying out the present invention. As best seen therein, a conventional smoke detector and alarm unit 15 is provided in the housing 10. The smoke detector and alarm unit 15 is of conventional design utilizing either a photo-electric type of detector or an ionization type of detector. A horn or some other means for producing a sensible signal (audible, visible or both) is included in the smoke detector unit 15.

Customarily, the smoke detector unit 15 is powered by means of a dry cell storage battery 16 connected in a circuit 17. A relay $C_3$ has its normally closed contacts connected in the circuit 17 and operates in its normally deactivated condition, as illustrated, to supply power to the smoke detector unit 15 for causing it to produce a signal in response to detected smoke.

For the purpose of temporarily deactivating the smoke detector unit 15, and automatically reactivating the same after a predetermined time delay, control means indicated generally at 20 is provided. The control means 20 includes a solid state timer 21 connected to a transistor $Q_1$ which in turn is connected to the coil of the relay $C_3$ described herefore. Power for the control means 20 is provided by a battery $B_1$ having its negative terminal connected to the negative lead 22 and having its positive terminal connected in the circuit 17 between the contacts of the relay $C_3$ and the negative of the battery 16. The positive lead 23 of the control means 20 is connected to a momentary contact switch $S_2$ via lead 24 to the positive terminal of the battery $B_1$. A resistor $R_7$ is connected in series with the coil of the relay $C_3$ across the lines 22 and 23. Thus, when contact is made across the switch $S_2$, a voltage potential is applied across the lines 23 and 22. As a result, when the voltage potential is applied across the lines 23 and 22, the coil of the relay $C_3$ is activated to close its normally-opened contacts. This effects a latching action with respect to the relay $C_3$ so that it remains latched even after the switch $S_2$ is opened. This also causes the circuit 17 to open and thereby to prevent power from being supplied to the smoke detector unit 15. As a result, the smoke detector unit 15 is incapable of producing a signal in response to the smoke as long as the relay $C_3$ is in this condition.

For the purpose of deenergizing the relay $C_3$, an NPN transistor is connector in parallel with the coil of the relay $C_3$. Normally, the transistor $Q_1$ is in the non-conducting state when a voltage potential is applied across the lines 23 and 22. However, when a positive pulse is applied to the base of the transistor $Q_1$, the transistor $Q_1$ conducts and shunts the relay coil $C_3$. This, causes the contacts to return to their normally closed position completing the circuit 17 and reactivating the smoke detector unit 15. A diode $D_1$ is connected in parallel with the coil of the relay $C_3$ to protect the same.

The transistor $Q_1$ is triggered, and the relay $C_3$ deactivated, after a predetermined length of time. To this end, the timer 21 is connected across the power lines 23 and 22 in the manner indicated, and its output connected by line 25 to the base of the transistor $Q_1$. Preferably, the timer 21 is an eight pin integrated circuit of the type XR2242M manufactured by Exar Integrated Systems, Inc. The integrated circuit 21 functions in a well known manner to produce a positive output from its terminal 3 after a predetermined interval. The timing function of the circuit is determined by the value of the capacitor $C_1$ and the resistors $R_2$, $R_3$, and $R_4$ connected to each of a single pole of the three pole rotary switch $S_1$ in the manner indicated. The other resistors $R_1$, $R_5$, and $R_6$, as well as the capacitor $C_2$ and the manner in which they are connected are provided to complement the internal circuitry of the integrated circuit 21. Values for each of these circuit components is set forth in Table 1. The values of the timing resistors $R_2$–$R_4$ enable the consumer to select the time delay to vary from 1 to 3 hours, simply by turning the rotary switch $S_1$.

TABLE I

| | | | |
|---|---|---|---|
| R1 | Resistor | 100,000 ohms | Metal Film |
| R2 | Resistor | 2,700,000 ohms | Metal Film |
| R3 | Resistor | 5,600,000 ohms | Metal Film |
| R4 | Resistor | 7,500,000 ohms | Metal Film |
| S1 | Switch | 3 pole 1 throw | Rotary |
| C1 | Capacitor | 10 uF | Solid Tantalum |
| C2 | Capacitor | .001uF | Ceramic Disc |
| IC1 | Long Range Timer | XR-2242M | Ceramic |
| R6 | Resistor | 4700 ohms | Metal Film |
| R7 | Resistor | 310 ohms | Metal Film |
| Q1 | Transistor | NPN | Low Power |
| D1 | Diode | 1N914 | |
| C3 | Relay | TTL | 2500 ohms Coil Resistance at 5V |
| S2 | Switch | SPST | Momentary |
| B1 | Battery | 9V. or 12V. | |
| T1 | Thermal Sensor | 135F. | |

With the foregoing, it may be seen that when contact across switch $S_2$ is made, as by a momentary pull on the pull chain 12, power supplied to the coil of the relay $C_3$ opens the normally closed contacts and thereby deactivates the smoke detector unit 15. Simultaneously, power is supplied to the integrated circuit 21 which, depending upon the position of the rotary switch $S_1$, begins its timing function. At the conclusion of the timing function, a positive voltage pulse appears at the output terminal 3 and is supplied via line 25 to the base of the transistor $Q_1$ to trigger the transistor. When the transistor conducts, it shunts the coil of the relay $C_3$ which causes its contacts to resume their normally closed configuration. When this occurs, the circuit 17 for the smoke detector unit 15 is again completed and the smoke detector unit 15 is reactivated.

In order to provide a margin of safety for the unit in the event an actual fire may break out during the period of time when it is temporarily inactive, a thermal override switch $T_1$ is connected in the circuit 17 in parallel with the normally-closed contacts of the relay $C_3$ and in series with the smoke detector unit 15. A thermal override switch $T_1$ is set to close at a predetermined temperature, such as 135° F. Thus, even though the normally-closed contacts of the relay $C_3$ may be open, the thermal switch $T_1$ will function to complete the circuit 17 in the event that a fire should break out and cause the ambient air temperature to reach the 135° F. actuation point. However, in order for the alarm to sound, smoke must also be detected by the detector unit 15.

In view of the foregoing, it should be apparent that the present invention now provides a fire alarm device which avoids the inconveniences and annoyances of present fire alarms without substantially sacrificing the safety and security they provide. For example, if the device were installed in a kitchen area, the consumer would simply pull the chain 12 before starting to cook. This would temporarily deactivate the smoke alarm during the period while cooking was in progress; however, it would automatically reset the alarm after the homeowner has finished cooking. As a result, in the event that smoke, fumes, vapors, etc. are generated in the cooking process, they will not inadvertently set off the alarm and cause annoyance and inconvenience. On the other hand, since the alarm automatically resets itself after the lapse of a predetermined time, as may be set by the homeowner, no conscious steps are required on the part of the homeowner to reset the alarm at the completion of cooking.

Thus, it should be apparent that the present invention provides a smoke alarm device which overcomes the deficiencies and inconveniences of known prior art devices.

While a preferred embodiment of the present invention has been described in detail, various modifications, alterations and changes may be made without departing from the spirit and scope of the present invention as defined in the appended claims.

It is noted that while it may be preferable for the homeowner to deactivate the alarm beforehand, should he forget and the alarm goes off inadvertently, such as during a party, cooking, etc., the homeowner can silence the alarm quickly and temporarily simply by pulling on the chain 12. The alarm automatically reactivates itself at a later time.

We claim:

1. A smoke alarm device, comprising:

a housing;

means for supplying electrical power in said housing;

means in said housing for detecting smoke and producing a sensible signal in response to detected smoke; and manually-actuated control means cooperating with said signal-producing means to temporarily deactivate the same and to automatically reactivate the same after a predetermined time interval, said control means including:

an integrated circuit timer having an input adapted to receive an electrical signal to initiate timing and having an output adapted to produce an electrical output signal upon completion of a predetermined time interval;

electrically-actuated means connected to said smoke detector and sensible signal producing means and operable in alternate modes to permit or to prevent a sensible signal from being produced in response to sensed smoke;

means for latching said electrically-actuated means in its signal preventing mode;

momentary-contact switch means in said housing coupled to said timer and said latching means for producing said timer input signal and for actuating said latching means; and means connected to said timer output and said latching means for deactivating said latching means at the completion of said time delay and thereby reactivating said smoke detecting and sensible signal producing means.

2. A smoke alarm device according to claim 1 including temperature responsive means in said housing operable during said time interval to override said control means and to afford actuation of said signal-producing means in response to smoke.

3. A smoke alarm device according to claim 2 wherein said power supply is contained in said housing and including a circuit connecting said power supply to said smoke detecting and signal-producing means, said electrically-actuated means including a relay connected in said circuit and operable to open said circuit during said time interval.

4. A smoke alarm device according to claim 3 wherein said temperature responsive means is connected in said circuit in parallel with said relay and in series with said smoke detecting means.

5. A smoke alarm device according to claim 4 wherein said relay has normally-closed contacts completing said power circuit, a coil operable to open said contacts when energized, and solid-state means operable in response to said timer output signal to shunt said relay coil after said time interval.

6. A smoke alarm device according to claim 5 wherein said relay has a common terminal and normally-open and normally closed contacts associated therewith, and said power supply means includes a first battery having one terminal connected to said timer, to said common relay terminal and to said momentary contact switch, said momentary-contact switch being connected to said normally open relay contact, to said relay coil, and to said timer, whereby power is supplied to the timer and relay coil during said time interval.

7. A smoke alarm device according to claim 6 wherein said power supply includes a second battery connected in series with said one battery, with said smoke detector and alarm producing means, and with the normally-closed contact of said relay.

8. A smoke alarm device according to claim 7 including a thermal switch connected in series with said smoke detecting and alarm producing means and said second battery.

* * * * *